US011719486B2

(12) United States Patent
Chhajed et al.

(10) Patent No.: US 11,719,486 B2
(45) Date of Patent: Aug. 8, 2023

(54) FASCIA AND DIVIDER WALL FOR A MACHINE COMPARTMENT

(71) Applicant: WHIRLPOOL CORPORATION, Benton Harbor, MI (US)

(72) Inventors: Rahul Chhajed, Pune (IN); Mansi Katkar, Vadgaonsheri (IN); Manjunathraddi Navalgund, Maharashtra (IN); Sanjesh Kumar Pathak, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 277 days.

(21) Appl. No.: 17/139,091

(22) Filed: Dec. 31, 2020

(65) Prior Publication Data

US 2022/0205705 A1 Jun. 30, 2022

(51) Int. Cl.

| | |
|---|---|
| ***F25D 23/00*** | (2006.01) |
| ***F25D 23/06*** | (2006.01) |
| ***A47B 96/04*** | (2006.01) |

(52) U.S. Cl.

CPC ..... *F25D 23/006* (2013.01); *F25D 23/003* (2013.01); *F25D 23/062* (2013.01); *A47B 96/04* (2013.01); *F25D 2323/002* (2013.01); *F25D 2323/0023* (2013.01)

(58) Field of Classification Search

CPC ... F25D 2323/00261; F25D 2323/0021; F25D 23/006; F25D 23/003; F25D 2323/0023; F25D 23/062; F25D 2323/002; A47B 96/04

See application file for complete search history.

(56) References Cited

U.S. PATENT DOCUMENTS

| | | | |
|---|---|---|---|
| 7,155,926 | B2 | 1/2007 | Chae et al. |
| 7,549,300 | B2 | 6/2009 | Chun et al. |
| 9,939,189 | B2 | 4/2018 | Koo et al. |
| 2010/0242525 | A1 | 9/2010 | Park et al. |

(Continued)

FOREIGN PATENT DOCUMENTS

| | | | |
|---|---|---|---|
| EP | 3647695 | A1 | 5/2020 |
| KR | 20000033333 | A | 6/2000 |

(Continued)

OTHER PUBLICATIONS

Machine English translation of KR 10-2006-0081806. Translated Nov. 2022 (Year: 2006).*

(Continued)

*Primary Examiner* — Cassey D Bauer
(74) *Attorney, Agent, or Firm* — Price Heneveld LLP

(57) ABSTRACT

A machine compartment assembly for an appliance cabinet includes a fascia that is configured to engage said appliance cabinet. The fascia includes an upper portion that defines a plurality of slots along a length of the upper portion. The fascia also includes a first side flange that is operably coupled to the upper portion and a second side flange that is operably coupled to the upper portion. The first side flange and the second side flange each define a slit. A divider wall is proximate to the fascia. The divider wall includes a wall body that has an outer edge and defines a warm air zone and a cool air zone. The divider wall also includes a gasket is operably coupled to the outer edge of the wall body.

19 Claims, 10 Drawing Sheets

(56) References Cited

U.S. PATENT DOCUMENTS

| | | | |
|---|---|---|---|
| 2016/0116204 | A1 | 4/2016 | Li et al. |
| 2020/0132313 | A1 | 4/2020 | Yoshino |

FOREIGN PATENT DOCUMENTS

| | | | | | |
|---|---|---|---|---|---|
| KR | 20010068977 | A | | 7/2001 | |
| KR | 10-2006-0081806 | | * | 7/2006 | ..... F25D 23/006 |
| KR | 10-0759047 | | * | 9/2007 | ..... F25D 21/004 |
| KR | 20070102190 | A | | 10/2007 | |
| WO | 2020173353 | A1 | | 9/2020 | |
| WO | 2020173359 | A1 | | 9/2020 | |

OTHER PUBLICATIONS

Machine English translation of KR 10-0759047. Translated Nov. 2022 (Year: 2007).*

* cited by examiner

FASCIA AND DIVIDER WALL FOR A MACHINE COMPARTMENT

BACKGROUND OF THE DISCLOSURE

The present disclosure generally relates to a machine compartment for an appliance, and more specifically, to a fascia and a divider wall for a machine compartment.

SUMMARY OF THE DISCLOSURE

According to one aspect of the present disclosure, an appliance includes a base. A wrapper is operably coupled to the base. A machine compartment is defined by the base and the wrapper. A divider wall is disposed within the machine compartment. The divider wall includes a wall body and a gasket that is operably coupled to the wrapper and defines a warm air zone and a cool air zone of the machine compartment. A fascia is operably coupled to the wrapper that is proximate to the machine compartment. The fascia includes an upper portion that defines a plurality of slots, a first side flange that is operably coupled to the upper portion, a second side flange that is operably coupled to an opposing end of the upper portion, and a central flange that is disposed between the first and second side flanges and operably coupled to the base.

According to another aspect of the present disclosure, a cabinet for an appliance includes a base. A rear wall is operably coupled to the base. A machine compartment is defined between the rear wall and the base. A fascia is operably coupled to the rear wall and is proximate to the machine compartment. The fascia includes first and second side flanges and an upper portion that cooperate to define at least one aperture. A divider wall is disposed within the machine compartment and is operably coupled to the rear wall.

According to yet another aspect of the present disclosure, a machine compartment assembly for an appliance cabinet includes a fascia that is configured to engage said appliance cabinet. The fascia includes an upper portion that defines a plurality of slots along a length of the upper portion. The fascia also includes a first side flange that is operably coupled to the upper portion and a second side flange that is operably coupled to the upper portion. The first side flange and the second side flange each define a slit. A divider wall is proximate to the fascia. The divider wall includes a wall body that has an outer edge and defines a warm air zone and a cool air zone. The divider wall also includes a gasket is operably coupled to the outer edge of the wall body.

These and other features, advantages, and objects of the present disclosure will be further understood and appreciated by those skilled in the art by reference to the following specification, claims, and appended drawings.

Figure 1:
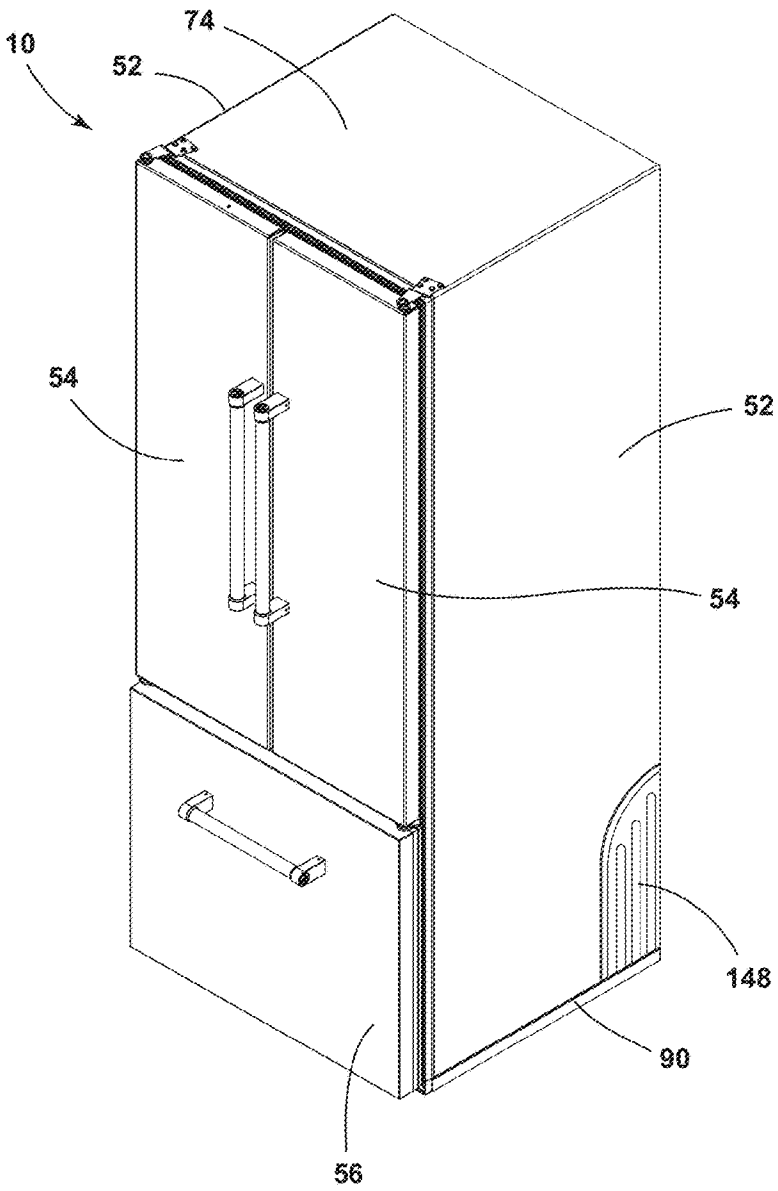
FIG. 1 is a front top perspective view of an appliance of the present disclosure.
Figure 2:
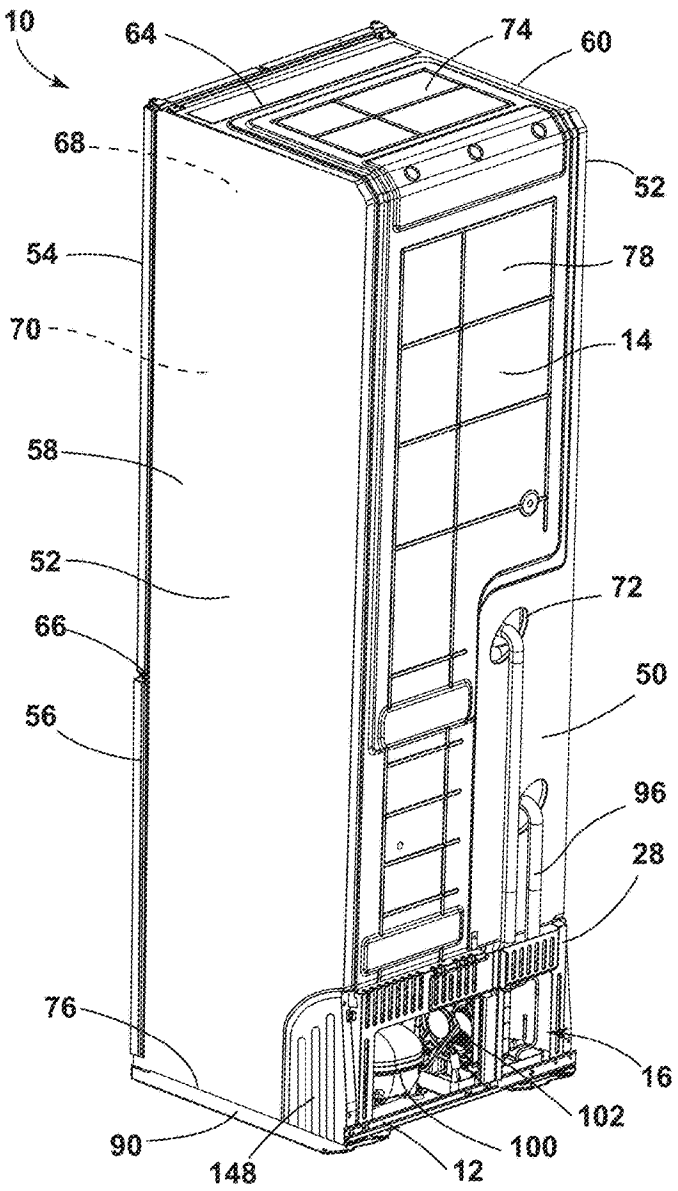
FIG. 2 is a rear top perspective view of a cabinet of an appliance of the present disclosure.
Figure 3:
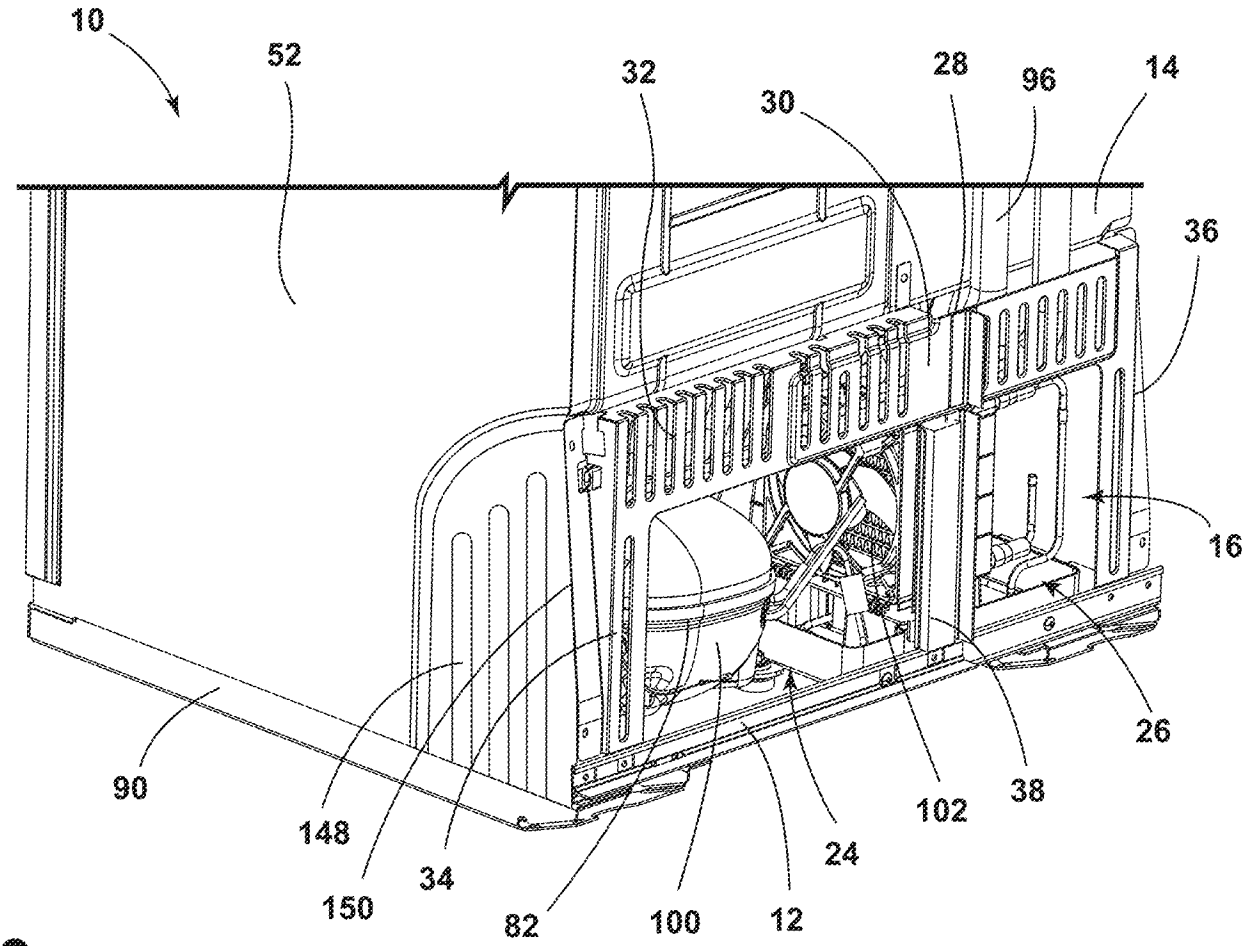
FIG. 3 is an enlarged partial perspective view of a machine compartment of the present disclosure with a fascia.
Figure 4:
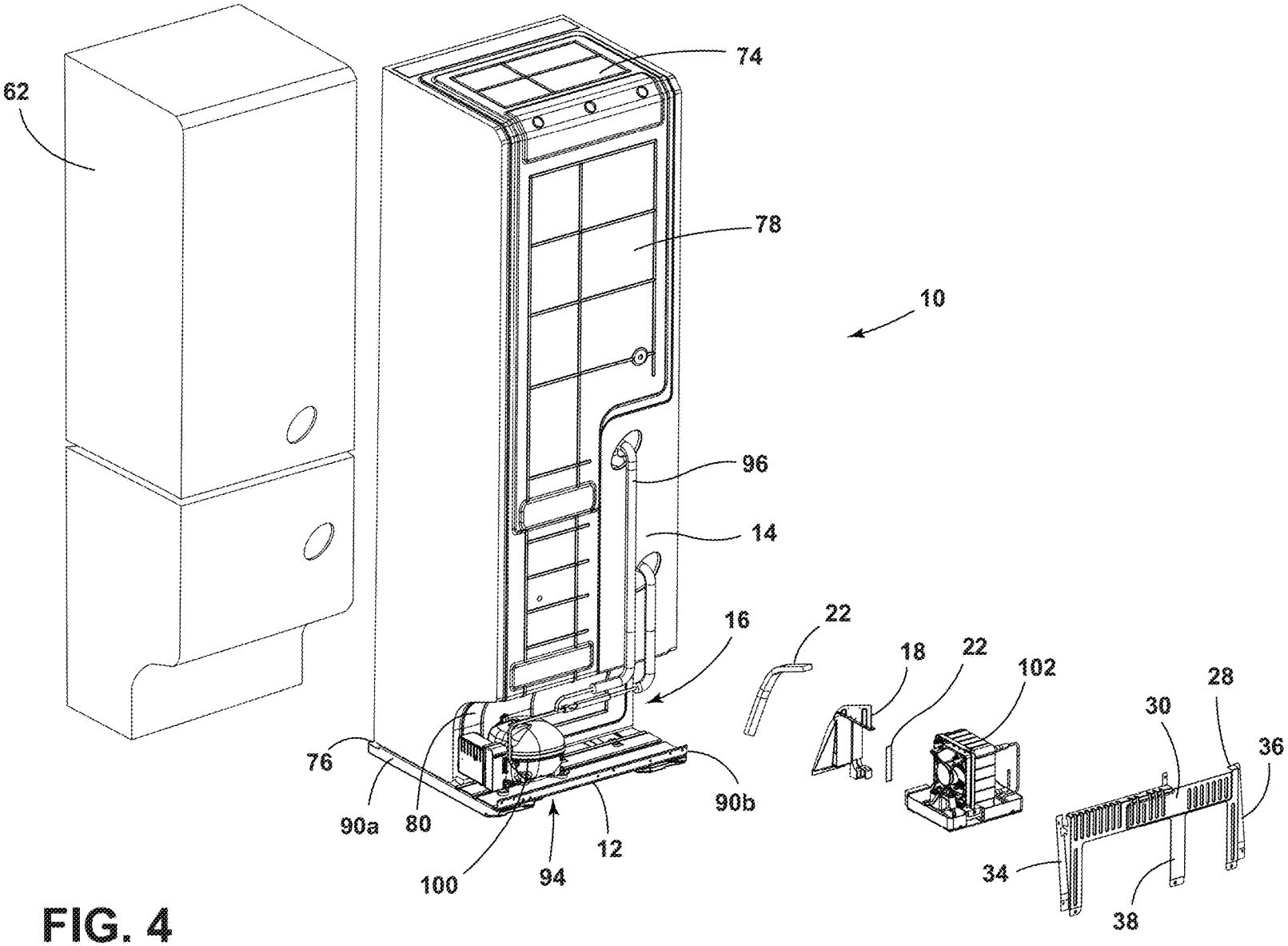
FIG. 4 is an exploded rear perspective view of an appliance with a machine compartment of the present disclosure with a fascia and a divider wall.
Figure 5:
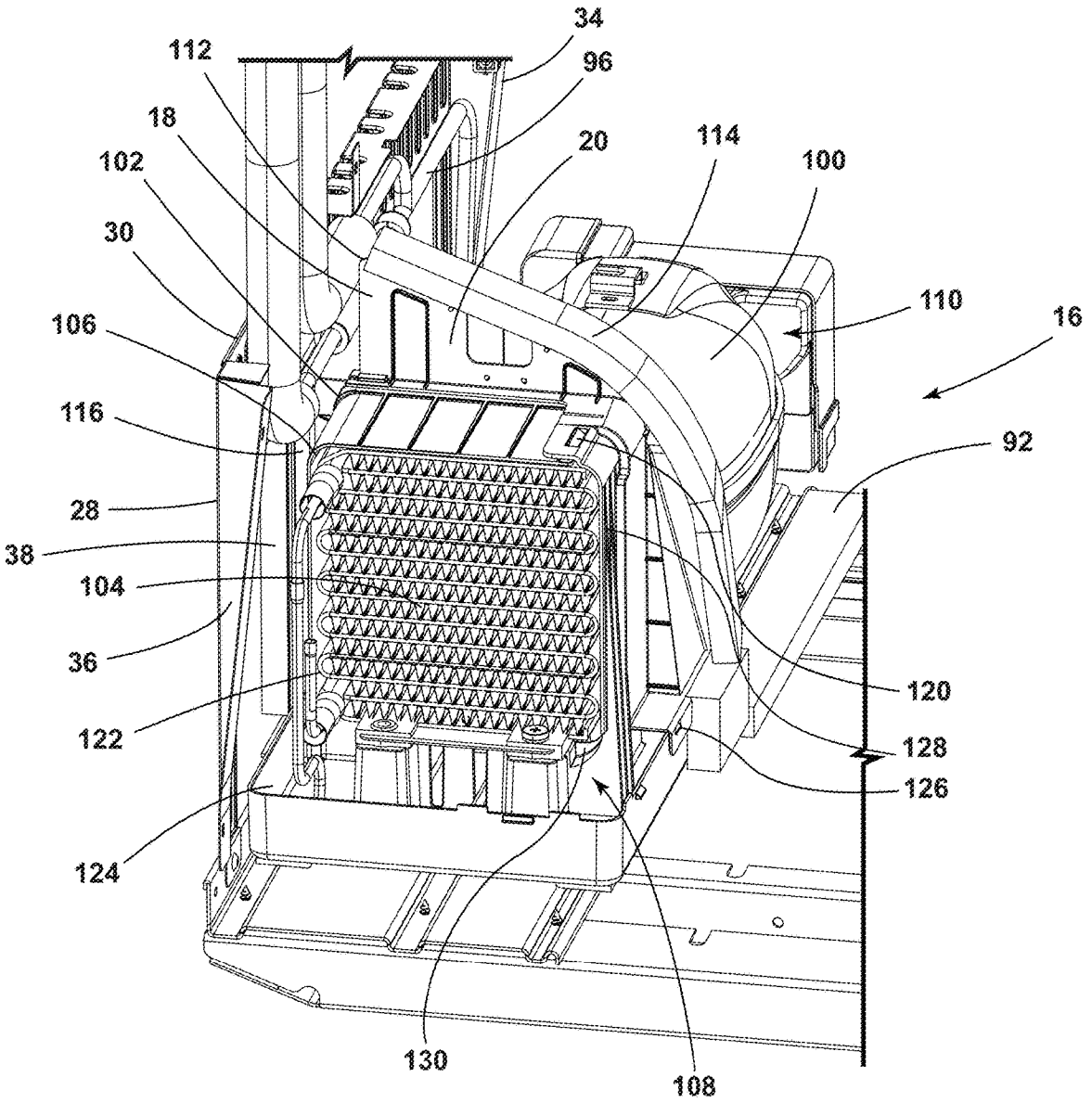
FIG. 5 is a partial enlarged rear perspective view of a machine compartment of the present disclosure
Figure 6:
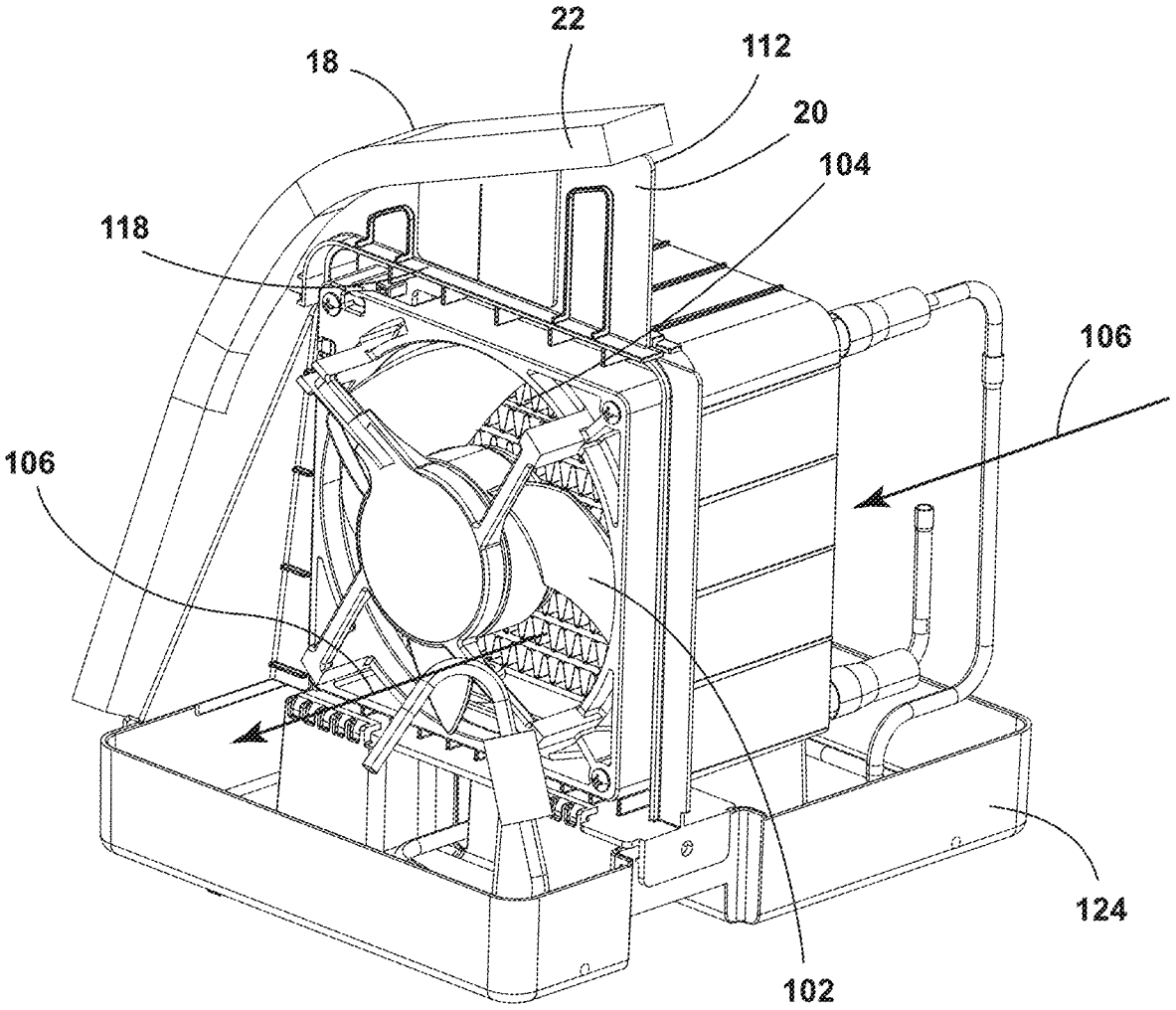
FIG. 6 is a side perspective view of a divider wall of the present disclosure operably coupled to a fan.
Figure 7:
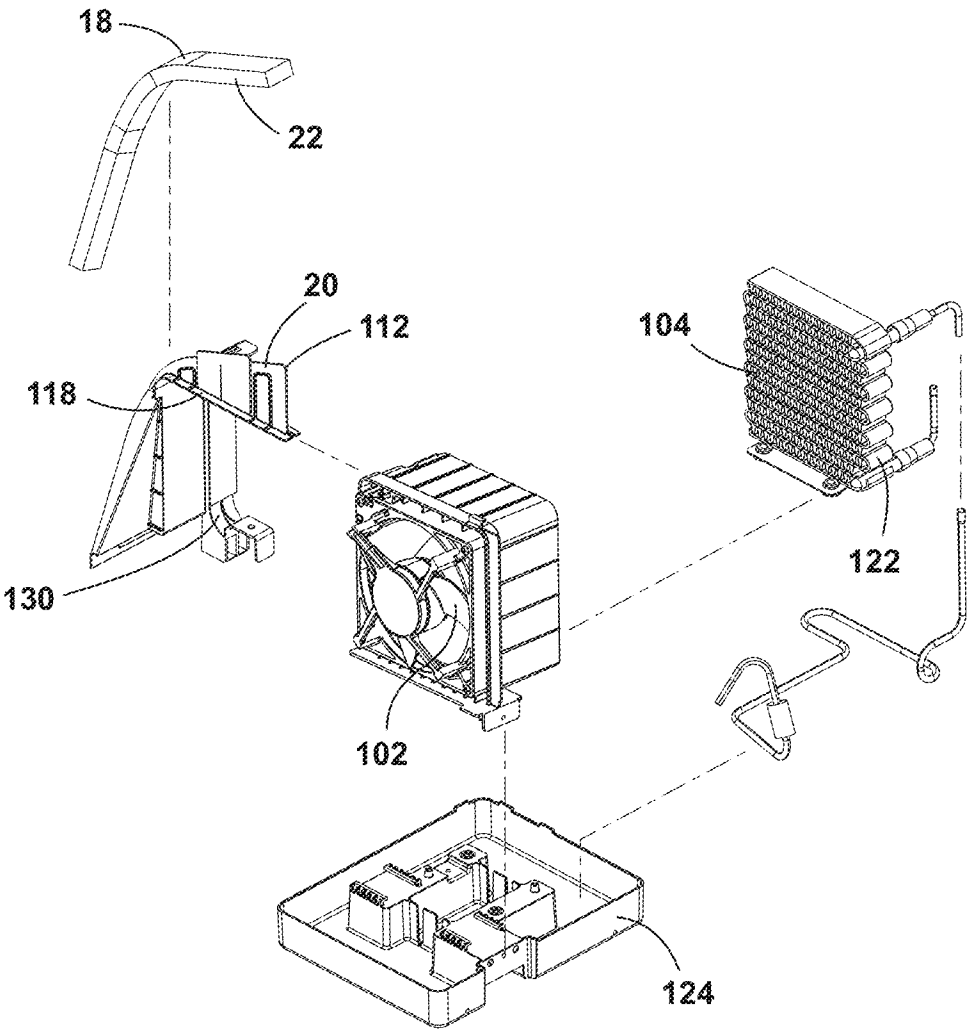
FIG. 7 is an exploded view of the divider wall and the fan of FIG. 6.

The components in the figures are not necessarily to scale, emphasis instead being placed upon illustrating the principles described herein.

DETAILED DESCRIPTION

The present illustrated embodiments reside primarily in combinations of method steps and apparatus components related to a fascia and divider wall for a machine compartment. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-10, reference numeral 10 generally designates an appliance that includes a base 12 and a wrapper 14 operably coupled to the base 12. A machine compartment 16 is defined by the base 12 and the wrapper 14, and a divider wall 18 is disposed within the machine compartment 16. The divider wall 18 includes a wall body 20 and a gasket 22 that is operably coupled to the wrapper 14. The divider wall 18 defines a warm air zone 24 and a cool air zone 26 of the machine compartment 16. A fascia 28 is operably coupled to the wrapper 14 proximate to the machine compartment 16. The fascia 28 includes an upper portion 30 that defines a plurality of slots 32. A first side flange 34 is operably coupled to the upper portion 30, and a second side flange 36 is operably coupled to an opposing end of the upper portion 30. A central flange 38 is disposed between the first and second side flanges 34, 36 and is operably coupled to the base 12.

Referring to FIGS. 1-4, the appliance 10 is illustrated as a refrigerating appliance, but it is also contemplated that the fascia 28 described herein may be used with a variety of appliances. The appliance 10 illustrated is a built-in appliance, such that a rear wall 50 and sidewalls 52 of the wrapper 14 may be generally exposed. It is generally contemplated that the rear wall 50 may be operably coupled to the base 12, described further below. The appliance 10 includes first and second doors 54, 56 operably coupled to a body 58 of the appliance 10. As described herein, the term body 58 may include similar features as the wrapper 14. For example, it is generally contemplated that the body 58 may be formed from a metallic material, a plastic material, or other materials typically used to form a cabinet 60 of the appliance 10.

The cabinet 60 is generally formed from the wrapper 14 and a liner 62 to which the wrapper 14 is coupled. The cabinet 60 is typically defined as an insulated structure 64 by the liner 62 and the wrapper 14. It is generally contemplated that the wrapper 14 and the liner 62 may be formed from metals, polymers, metal alloys, combinations thereof, and other substantially rigid materials that can be used for vacuum insulated structures within appliances. The liner 62 and the wrapper 14 are typically coupled to a trim breaker 66 to form the insulated structure 64. The liner 62 and the wrapper 14 also define an insulating cavity 68 therebetween in which one or more insulation materials 70 may be disposed. It is generally contemplated that the insulation materials 70 may be a glass-type material, a carbon-based powder, silicone oxide-based materials, insulating gases, and other standard insulation materials 70 known in the art. The insulation materials 70 substantially fill the insulating cavity 68 to form a substantially continuous layer between the liner 62 and the wrapper 14. The insulating cavity 68 is evacuated by a vacuum to further define the insulated structure 64 as a vacuum insulated structure.

With further reference to FIGS. 1-4, holes 72 are defined by the wrapper 14 and the liner 62 to provide a passage for electrical wiring and other typical appliance lines. For purposes of this disclosure, the wrapper 14 is described in detail; however, the liner 62 can be similarly constructed insofar as the liner 62 and the wrapper 14 generally have a similar shape to form the insulated structure 64. The wrapper 14 has top and bottom surfaces 74, 76, a rear planar surface 78, and a curved surface 80 as well as the sidewalls 52 mentioned above. The bottom surface 76 of the wrapper 14 is operably coupled to the base 12. The curved surface 80 of the wrapper 14 and the base 12 at least partially define the machine compartment 16. Stated differently, machine components 82 can be positioned on the base 12 within the machine compartment 16 beneath the rear planar surface 78 and proximate to the curved surface 80 of the wrapper 14.

The wrapper 14 is positioned on and coupled to the base 12, which structurally supports the appliance 10. The base 12 may be formed from metal, plastic, or other materials known to provide structural, base support for the appliance 10. The base 12 may be a single piece of material extending across the bottom surface 76 of the wrapper 14. Additionally or alternatively, the base 12 may include base rails 90 positioned proximate to the sidewalls 52 of the appliance cabinet 60 and coupled to the bottom surface 76 of the wrapper 14. In either construction, the base 12 at least partially extends beyond the curved surface 80 of the wrapper 14 to lie substantially perpendicular with the rear planar surface 78 of the wrapper 14.

Referring now to FIGS. 4-7, the base rails 90 include a first rail 90*a* and a second rail 90*b*, which may be collectively referred to as the base rails 90. A support plate 92 configured to support the machine components 82 within the machine compartment 16 can be positioned over and coupled to the base rails 90 to define a gap 94 therebetween. The gap 94 may provide passage for the electrical wiring and/or appliance lines 96. For example, when the appliance 10 is a refrigerator and/or freezer, appliance lines 96 configured to direct water are connected to the appliance 10 and may pass through the gap 94 defined by the base rails 90 and the support plate 92.

As mentioned above, the machine compartment 16 includes the divider wall 18 in addition to the machine components 82. The machine components 82 of the machine compartment 16 include, but are not limited to a compressor 100, a fan 102, and a condenser 104. The fan 102 is generally disposed between the compressor 100 and the condenser 104, and the fan 102 is operably coupled to the condenser 104 to direct an airflow 106 from a condenser side 108 of the machine compartment 16 to a compressor side 110 of the machine compartment 16. It is generally contemplated that the divider wall 18 separates the condenser side 108 and the compressor side 110 of the machine compartment 16 to define the cool air zone 26 and the warm air zone 24, respectively. The divider wall 18 minimizes recirculation of the airflow 106 between the warm air zone 24 and the cool air zone 26, as described below.

The compressor 100 operates to compress a thermal exchange media, which is ultimately cooled and condensed by the condenser 104. This thermal regulation process is described in further detail below. The compressor 100 generates and releases energy in the form of heat during operation, which ultimately defines the warm air zone 24 of the machine compartment 16. The condenser 104 releases a cool draft into the machine compartment 16 to define the cool air zone 26. The condenser 104 remains separated from the compressor 100 via the divider wall 18 to minimize the heat from the compressor 100 impacting the operation of the condenser 104.

For example, in conventional machine compartments the condenser may be exposed to the heat radiating from the compressor. The more heat that the condenser is exposed to, the less efficient the condenser may be at cooling the system. This inefficiency in a conventional system may lead to the compressor ultimately working more to compensate for the heated condenser. Thus, it is advantageous separate and segregate the compressor and the condenser to maintain an efficient system.

With further reference to FIGS. 4-7, the divider wall 18 is disposed around the fan 102 and is operably coupled to the fan 102. As mentioned above, the divider wall 18 includes the wall body 20 and the gasket 22. The gasket 22 is generally disposed around an outer edge 112 of the wall body 20 and is operably coupled to the curved surface 80 of the wrapper 14. The gasket 22 may be formed from a generally compressive material and is generally configured to absorb movement or other engagement between the wrapper 14 and the divider wall 18. It is also contemplated that the gasket 22 can include a first gasket 114 and a second gasket 116. The first gasket 114 extends along the wall body 20 proximate to the curved surface 80 of the wrapper 14, and the second gasket 116 extends along a side of the fan 102 proximate to the central flange 38. For example, the second gasket 116 extends along a side of the fan 102 between the fan 102 and the central flange 38. In such configuration, the second gasket 116 generally minimizes contact between the central flange 38 of the fascia 28, and the first gasket 114 minimizes contact between the wall body 20 and the wrapper 14.

The wall body 20 extends around an outer wall 118 of the fan 102 to define a barrier between the warm air zone 24 and the cool air zone 26. It is generally contemplated that the wall body 20 can be formed from a metal, a plastic, or any other generally rigid material that resists airflow penetration. A portion of the wall body 20 may extend into the cool air zone 26 and is coupled to the outer wall 118 of the fan 102. The fan 102 includes retention clips 120 that couple the wall body 20 to the fan 102. Additionally or alternatively, the outer wall 118 of the fan 102 may include a peripheral flange that can define a groove in which the wall body 20 can be disposed. It is also contemplated that the wall body 20 may be welded, fastened, or otherwise coupled to the fan 102. In any one of these configurations, the addition of the wall body 20 minimizes the mixing of the airflow 106 between the warm air zone 24 and the cool air zone 26 of the machine compartment 16.

With further reference to FIGS. 4-7, the outer wall 118 of the fan 102 defines a space 122 in which the condenser 104 is positioned. The wall body 20 of the divider wall 18 may be positioned proximate to the condenser 104 within the cool air zone 26 to further minimize mixing of the warm air zone 24 and the cool air zone 26. The condenser 104 and the fan 102 may be operably coupled to a container 124, which is operably coupled to the support plate 92 of the base 12. The container 124 also includes retention clips 126 similar to the retention clips 120 of the fan 102, and the wall body 20 is also operably coupled to the retention clips 126 of the container 124. It is also contemplated that the wall body may be spot welded, welded, or coupled to the fan 102 and the container 124 by coupling methods other than the retention clips 120, 126.

An extension wall 128 of the wall body 20 extends along a side of the condenser 104 and is coupled to one of the retention clips 120 of the fan 102. The extension wall 128 includes a curved end 130 that extends beneath the condenser 104. It is generally contemplated that the extension wall 128, in particular the curved end 130, helps to channel the cool draft from the condenser 104 within the cool air zone 26. The extension wall 128 also forms a barrier between any potential warm air from the warm air zone 24 and the condenser 104. As will be described further below, the fan 102 is configured to direct the airflow 106 away from the condenser 104 and toward the compressor 100, which both minimizes the mixing of warm air from the warm air zone 24 with the cool air zone 26 and at least partially cools the compressor 100 to maintain the overall efficiency of the system.

Figure 8:
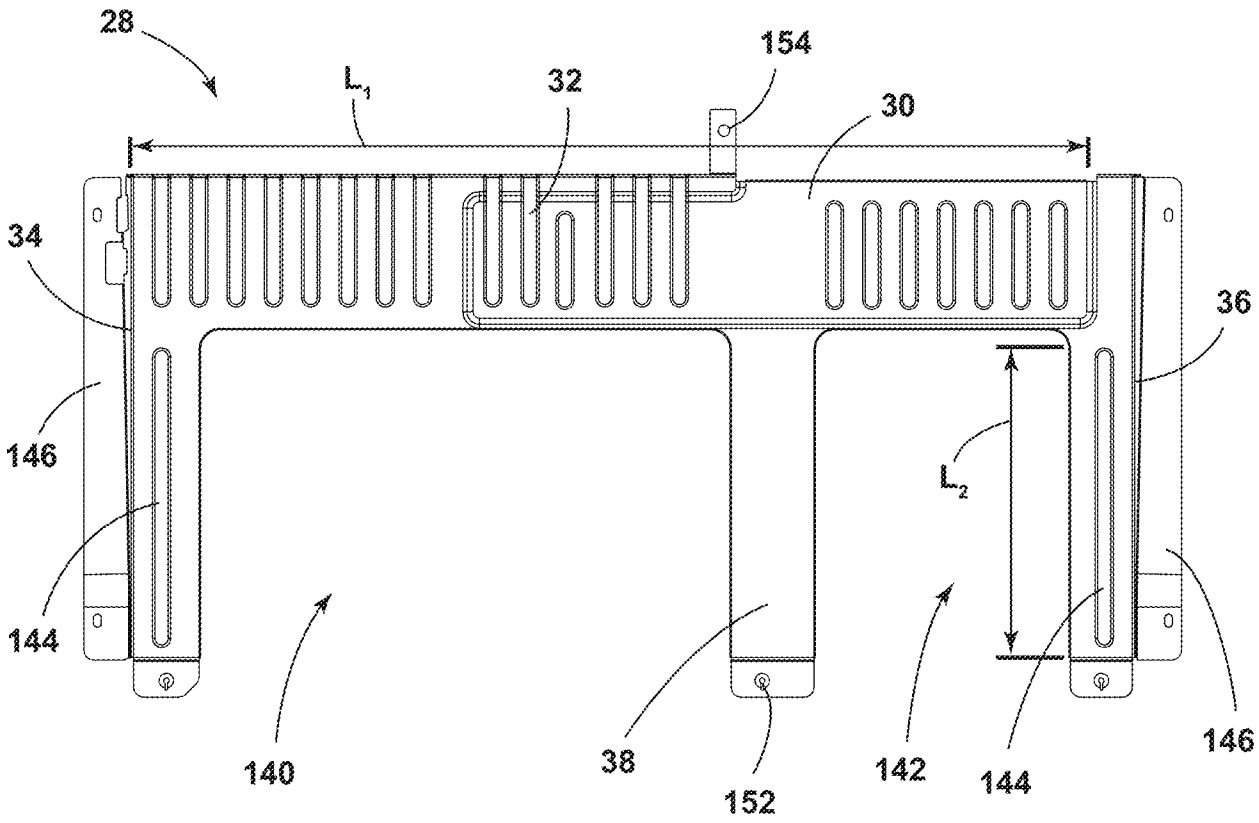
FIG. 8 is a side elevational view of a fascia of the present disclosure with a central flange.
Figure 9:
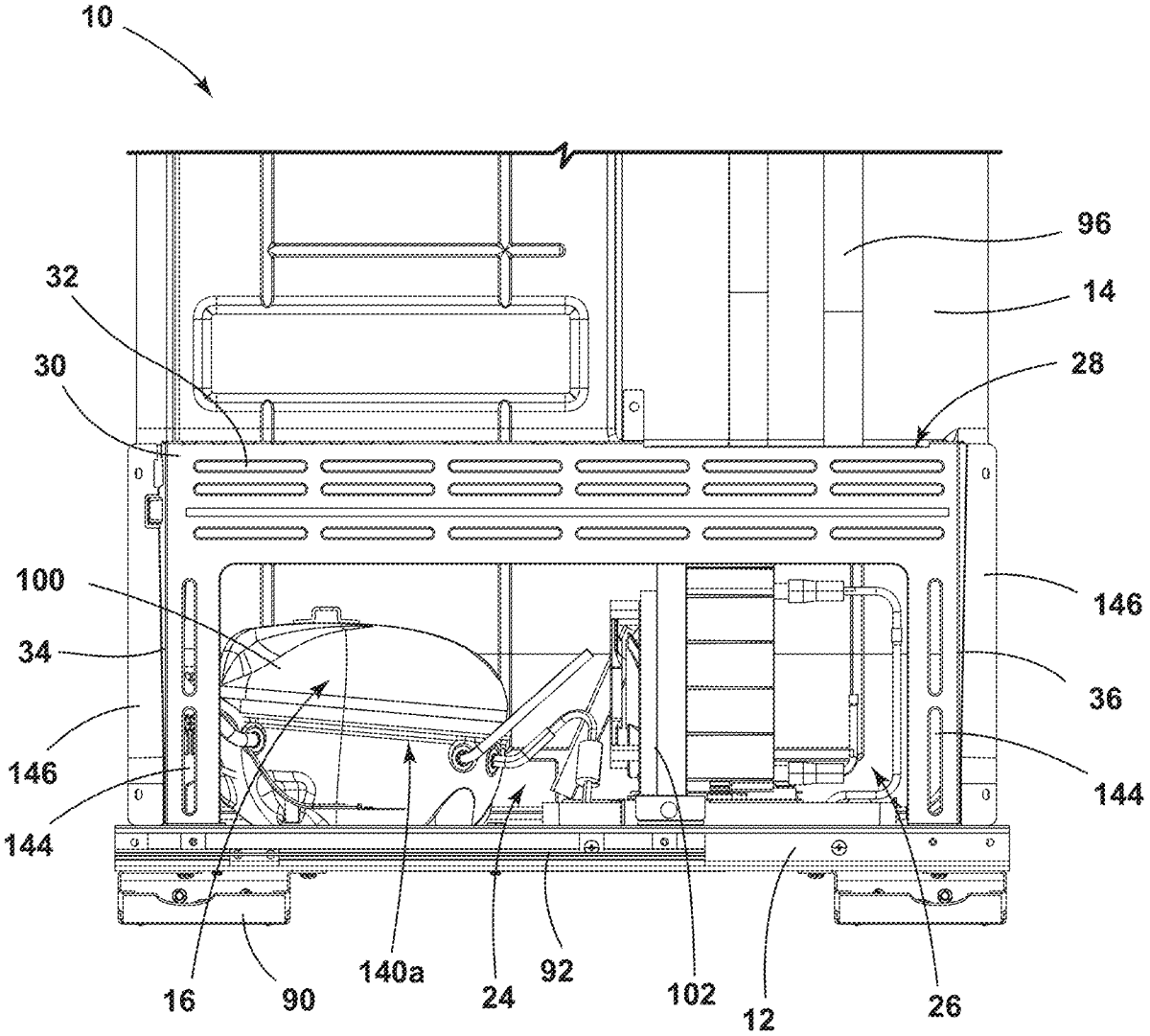
FIG. 9 is a partial side elevational view of a machine compartment with a fascia of the present disclosure.
Figure 10:
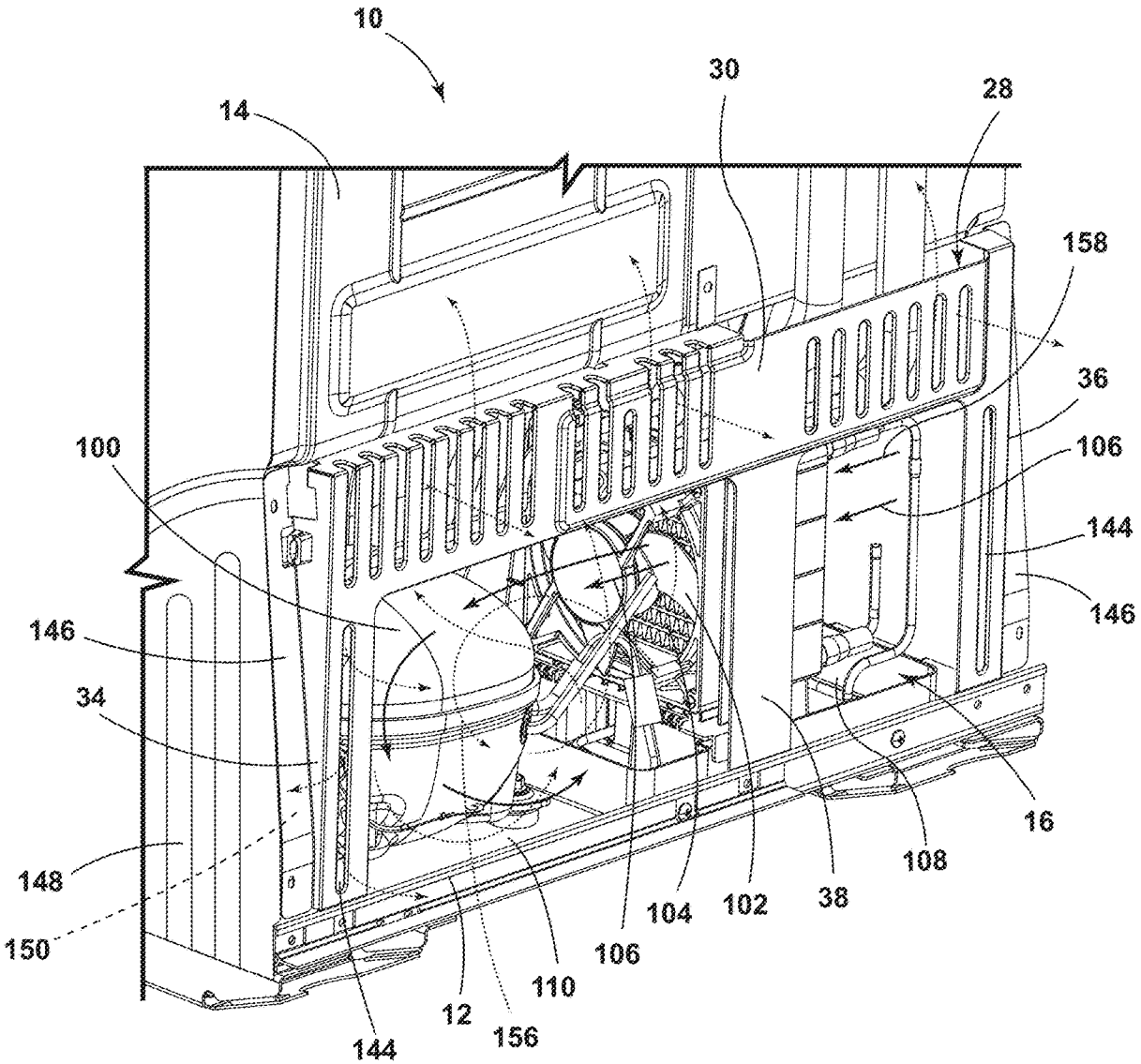
FIG. 10 is a partial side perspective view of a machine compartment of the present disclosure with an airflow path illustrated in solid lines.

Referring now to FIGS. 8-10 and as mentioned above, the fascia 28 includes the upper portion 30 that defines the plurality of slots 32 along a length $L_1$ of the upper portion 30. The first side flange 34 and the central flange 38 cooperate to define a first aperture 140 of the fascia 28, and the second side flange 36 and the central flange 38 cooperate to define a second aperture 142 of the fascia 28. As illustrated in FIG. 8, the plurality of slots 32 are defined above the first aperture 140 and above the second aperture 142, such that the upper portion 30 remains solid proximate to the central flange 38, described further below. The first and second apertures 140, 142 generally provide access to the machine compartment 16. The warm air zone 24 is partially defined by the first side flange 34 and the central flange 38. The cool air zone 26 is partially defined by the second side flange 36 and the central flange 38. The first and second side flanges 34, 36, each define a slit 144 along a length L2 of each of the first and second side flanges 34, 36.

It is generally contemplated that the slit 144 defined by the first side flange 34 is configured to direct the airflow 106 within the machine compartment 16 from inside the machine compartment 16 to an area exterior to the machine compartment 16. It is also contemplated that the plurality of slots 32 defined along the upper portion 30 of the fascia 28 are configured to direct the airflow 106 into and out of the machine compartment 16 to at least partially regulate the warm air zone 24 and the cool air zone 26. By way of example, not limitation, the airflow 106 may be directed into the slots 32 proximate to the cool air zone 26 and directed out of the slots 32 proximate to the warm air zone 24. Additionally or alternatively, the airflow 106 may be directed out of all of the plurality of slots 32 defined by the upper portion 30 of the fascia 28 to regulate the warm air zone 24 and the cool air zone 26.

With further reference to FIGS. 8-10, the first and second side flanges 34, 36 each also include an attachment portion 146 proximate to the slits 144. The attachment portion 146 is configured to couple the fascia 28 to a side panel 148 of the appliance 10. The side panel 148 is coupled to the base 12, and the attachment portion 146 is coupled to a flange 150 of the side panel 148. It is also contemplated that each of the first and second side flanges 34, 36 and the central flange 38 are coupled to the base 12 via coupling features 152, such as screws. The coupling features 152 may also include, but are not limited to, rivets, nuts and bolts, and other coupling features 152 generally known in the art. It is also contemplated that the fascia 28 may be coupled to the wrapper 14 via spot welding or other attachment methods. For example, the fascia 28 also includes at least one extension 154 that upwardly extends from the upper portion 30 of the fascia 28 and is configured to operably couple the fascia 28 to the wrapper 14.

The fascia 28 may be configured, as described above, with the first and second side flanges 34, 36 and the central flange 38. In such a configuration, the fascia 28 defines the first and second apertures 140, 142 to provide access into the machine compartment 16. In an alternate configuration, the fascia 28 defines a single aperture 140*a*, such that the fascia 28 is free from the central flange 38. This alternate configuration of the fascia 28 may provide maximized access to the machine compartment 16. It is generally contemplated that, in either configuration, the upper portion 30 of the fascia 28 conceals appliance lines 96 that extend toward the machine compartment 16 while maximizing the airflow 106 into and out of the machine compartment 16.

With further reference to FIGS. 8-10, the compressor 100 is operably coupled to the condenser 104, which condenses a thermal exchange media from a gaseous state into a liquid state. This, at least partially, defines the cooling effect of the refrigeration system. As mentioned above, the cool air zone 26 is defined as the condenser side 108 of the machine compartment 16 as the condenser 104 is configured to cool the thermal exchange media in the gaseous state from the compressor 100 into the liquid state. The condenser 104 typically releases a cool draft as compared to the compressor 100. The cooled thermal exchange media is utilized to cool the appliance 10. The compressor 100 and the condenser 104 are separated from one another by the divider wall 18 in order to maximize the efficiency of the refrigeration system, as mentioned above. The divider wall 18 blocks the heat released by the compressor 100 from acting upon the condenser 104.

In addition, the fan 102 is configured to direct the airflow 106 from the condenser side 108 to the compressor side 110. The fan 102 maintains the cool air zone 26 by redirecting the airflow 106, which maximizes the overall efficiency of the refrigeration system. The combination of the fan 102 and the divider wall 18 maximizes the efficiency of at least the compressor 100 by keeping warm air within the warm air zone 24 separate from the condenser 104 in the cool air zone 26. The divider wall 18 is disposed around the fan 102 to at least partially seal off the warm air zone 24 of the machine compartment 16 from the cool air zone 26. As mentioned above, the fan 102 is directed toward the warm air zone 24 of the machine compartment 16 to prevent a warm airflow path 156 that may radiate from the compressor 100. Instead, the warm airflow path 156 may be expelled from the warm air zone 24 through the first aperture 140, the slit 144 defined by the first side flange 34, and the plurality of slots 32 defined by the fascia 28.

The suction generated by the fan 102 maintains the cool air zone 26 and minimizes potential penetration of the warm airflow path 156 from the warm air zone 24. The second aperture 142 is illustrated as being smaller than the first aperture 140, such that more of a cool airflow 158 within the cool air zone 26 is retained and can be directed toward the warm air zone 24. The maintenance of the cool air zone 26 minimizes the work of the compressor 100 to operate the refrigeration system. Moreover, the cooling of the warm air zone 24 with the cool airflow 158 via the fan 102 helps to maintain the overall regulation and operation of the compressor 100 within the warm air zone 24.

Referring again to FIGS. 1-10, the divider wall 18 and the fascia 28 help to regulate the refrigeration system. Specifically, the divider wall 18 minimizes potential mixing between the warm air zone 24 and the cool air zone 26, which maximizes the efficiency of the refrigeration system. Retaining the warm air within the warm air zone 24 minimizes the likelihood that the compressor 100 will work harder to cool the condenser 104 to maintain the temperature of the overall system. Further, the fascia 28 advantageously provides an outlet for the airflow 106 while covering the appliance lines 96 that may otherwise be exposed. Thus, the fascia 28 provides coverage of the appliance lines 96 to minimize the user contacting the appliance lines 96 while allowing the airflow 106 to efficiently circulate within, into, and out of the machine compartment 16.

The invention disclosed herein is further summarized in the following paragraphs and is further characterized by combinations of any and all of the various aspects described therein.

According to one aspect of the present disclosure, an appliance includes a base. A wrapper is operably coupled to the base. A machine compartment is defined by the base and the wrapper. A divider wall is disposed within the machine compartment. The divider wall includes a wall body and a gasket that is operably coupled to the wrapper and defines a warm air zone and a cool air zone of the machine compartment. A fascia is operably coupled to the wrapper that is proximate to the machine compartment. The fascia includes an upper portion that defines a plurality of slots, a first side flange that is operably coupled to the upper portion, a second side flange that is operably coupled to an opposing end of the upper portion, and a central flange that is disposed between the first and second side flanges and operably coupled to the base.

According to another aspect, a first side flange and a central flange cooperate to define a first aperture, and a second side flange and the central flange cooperate to define a second aperture. The first and second apertures provide access to a machine compartment.

According to another aspect, a warm air zone is partially defined by a first side flange and a central flange. A cool air zone is partially defined by a second side flange and the central flange.

According to another aspect, a fan is disposed within a machine compartment that is proximate to a divider wall. The divider wall is coupled to and surrounds the fan to separate a warm air zone and a cool air zone.

According to another aspect, first and second side flanges each define a slit that is configured to direct an airflow path exterior to a machine compartment and within the machine compartment.

According to another aspect, a plurality of slots are defined along an upper portion of a fascia to direct an airflow path into and out of a machine compartment to at least partially regulate a warm air zone and a cool air zone.

According to another aspect, a gasket of a divider wall is operably coupled to a wrapper and a central flange around a wall body.

According to another aspect of the present disclosure, a cabinet for an appliance includes a base. A rear wall is operably coupled to the base. A machine compartment is defined between the rear wall and the base. A fascia is operably coupled to the rear wall and is proximate to the machine compartment. The fascia includes first and second side flanges and an upper portion that cooperate to define at least one aperture. A divider wall is disposed within the machine compartment and is operably coupled to the rear wall.

According to another aspect, a divider wall includes a wall body and a gasket that are operably coupled to a rear wall and a fascia.

According to another aspect, a fascia includes a central flange. At least one aperture includes a first aperture and a second aperture.

According to another aspect, a first side flange and a central flange cooperate to define a first aperture. A second side flange and the central flange cooperate to define a second aperture.

According to another aspect, a divider wall defines a warm air zone and a cool air zone within a machine compartment. The divider wall minimizes recirculation of airflow between the warm air zone and the cool air zone.

According to another aspect, an upper portion of a fascia define a plurality of slots along a length of the upper portion. A plurality of slots are configured to maintain a warm air zone and a cool air zone.

According to another aspect, a cabinet further includes a fan that is disposed within a machine compartment and is operably coupled to a base. A divider wall is disposed around the fan to define a warm air zone and a cool air zone of the machine compartment.

According to yet another aspect of the present disclosure, a machine compartment assembly for an appliance cabinet includes a fascia that is configured to engage said appliance cabinet. The fascia includes an upper portion that defines a plurality of slots along a length of the upper portion. The fascia also includes a first side flange that is operably coupled to the upper portion and a second side flange that is operably coupled to the upper portion. The first side flange and the second side flange each define a slit. A divider wall is proximate to the fascia. The divider wall includes a wall body that has an outer edge and defines a warm air zone and a cool air zone. The divider wall also includes a gasket is operably coupled to the outer edge of the wall body.

According to another aspect, a fascia directs an airflow path relative to regulate a warm air zone and a cool air zone of a machine compartment.

According to another aspect, an airflow path is directed via a plurality of slots.

According to another aspect, the machine compartment assembly further includes a fan that is operably coupled to a divider wall and further defines a warm air zone and a cool air zone.

According to another aspect, a fascia includes a central flange that is operably coupled to a divider wall.

According to another aspect, a divider wall includes a gasket that is operably coupled to a central flange.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An appliance, comprising:

a base;

a wrapper operably coupled to the base;

a machine compartment defined by the base and the wrapper;

a divider wall disposed within the machine compartment, the divider wall including a wall body and a gasket operably coupled to the wrapper and defining a warm air zone and a cool air zone of the machine compartment; and a fascia operably coupled to the wrapper proximate to the machine compartment, the fascia including:

an upper portion defining a plurality of slots;

a first side flange operably coupled to the upper portion;

a second side flange operably coupled to an opposing end of the upper portion; and a central flange disposed between the first and second side flanges and operably coupled to the base, wherein the first side flange and the central flange cooperate to define a first aperture and the second side flange and the central flange cooperate to define a second aperture, and wherein the first and second apertures provide access to the machine compartment.

2. The appliance of claim 1, wherein the warm air zone is partially defined by the first side flange and the central flange, and wherein the cool air zone is partially defined by the second side flange and the central flange.

3. The appliance of claim 1, further comprising:

a fan disposed within the machine compartment proximate to the divider wall, wherein the divider wall is coupled to and surrounds the fan to separate the warm air zone and the cool air zone.

4. The appliance of claim 1, wherein the first and second side flanges each define a slit configured to direct an airflow path exterior to the machine compartment and within the machine compartment.

5. The appliance of claim 4, wherein the plurality of slots defined along the upper portion of the fascia direct the airflow path into and out of the machine compartment to at least partially regulate the warm air zone and the cool air zone.

6. The appliance of claim 1, wherein the gasket of the divider wall is operably coupled to the wrapper and the central flange around the wall body.

7. A cabinet for an appliance, comprising:

a base;

a rear wall operably coupled to the base;

a machine compartment defined between the rear wall and the base;

a fascia operably coupled to the rear wall proximate to the machine compartment, the fascia including first and second side flanges and an upper portion that cooperate to define at least one aperture, wherein the first side flange at least partially defines a first aperture and the second side flange at least partially defines a second aperture, and wherein the first and second apertures provide access to the machine compartment; and a divider wall disposed within the machine compartment and operably coupled to the rear wall.

8. The cabinet of claim 7, wherein the divider wall includes a wall body and a gasket operably coupled to the rear wall and the fascia.

9. The cabinet of claim 7, wherein the fascia includes a central flange.

10. The cabinet of claim 9, wherein the first side flange and the central flange cooperate to define the first aperture, and wherein the second side flange and the central flange cooperate to define the second aperture.

11. The cabinet of claim 7, wherein the divider wall defines a warm air zone and a cool air zone within the machine compartment, and wherein the divider wall minimizes recirculation of airflow between the warm air zone and the cool air zone.

12. The cabinet of claim 11, wherein the upper portion of the fascia defines a plurality of slots along a length of the upper portion, and wherein the plurality of slots are configured to maintain the warm air zone and the cool air zone.

13. The cabinet of claim 7, further comprising:

a fan disposed within the machine compartment and operably coupled to the base, wherein the divider wall is disposed around the fan to define a warm air zone and a cool air zone of the machine compartment.

14. A machine compartment assembly for an appliance cabinet, comprising:

a fascia configured to engage said appliance cabinet, the fascia including:

an upper portion defining a plurality of slots along a length of the upper portion;

a first side flange operably coupled to the upper portion and at least partially defining a first aperture; and a second side flange operably coupled to the upper portion and at least partially defining a second aperture, wherein the first side flange and the second side flange each define a slit, and wherein the first and second apertures provide access to said machine compartment; and a divider wall proximate to the fascia, the divider wall including a wall body having an outer edge and defining a warm air zone and a cool air zone and a gasket operably coupled to the outer edge of the wall body.

15. The machine compartment assembly of claim 14, wherein the fascia directs an airflow path to regulate the warm air zone and the cool air zone of the machine compartment.

16. The machine compartment assembly of claim 15, wherein the airflow path is directed via the plurality of slots.

17. The machine compartment assembly of claim 14, further comprising:

a fan operably coupled to the divider wall and further defining the warm air zone and the cool air zone.

18. The machine compartment assembly of claim 14, wherein the fascia includes a central flange operably coupled to the divider wall.

19. The machine compartment assembly of claim 18, wherein the gasket is operably coupled to the central flange.

* * * * *